US005144969A

United States Patent [19]

Chou et al.

[11] Patent Number: 5,144,969

[45] Date of Patent: Sep. 8, 1992

[54] FULLY AUTOMATIC COLLAPSIBLE UMBRELLA

[75] Inventors: Luc L. Chou; Jonathan C. Cheng, both of Taipei, Taiwan

[73] Assignee: DAY Sheng-Tong, Taichung, Taiwan

[21] Appl. No.: 758,699

[22] Filed: Sep. 12, 1991

[51] Int. Cl.[5] ..... A45B 25/14

[52] U.S. Cl. ..... 135/22; 135/24; 135/39; 135/40

[58] Field of Search ..... 135/22-24, 135/25.1, 25.3, 25.31, 26, 38, 39, 40, 41, 15.1, 25.33, 25.41

[56] References Cited

U.S. PATENT DOCUMENTS

| | | | |
|---|---|---|---|
| 959,383 | 5/1910 | Pezzene | 135/23 X |
| 1,091,895 | 3/1914 | Schaaf | 135/24 X |
| 1,117,365 | 11/1914 | Frisk et al. | 135/23 X |
| 2,705,967 | 4/1955 | Zimmermann et al. | 135/22 |
| 3,677,274 | 7/1972 | Yasuda et al. | 135/24 |
| 4,548,222 | 10/1985 | Day | 135/24 |
| 4,682,617 | 7/1987 | Schultes et al. | 135/38 |
| 4,860,776 | 8/1989 | McQuain | 135/24 X |
| 5,036,872 | 8/1991 | Huang | 135/24 X |
| 5,058,613 | 10/1991 | Su et al. | 135/24 X |

FOREIGN PATENT DOCUMENTS

| | | | |
|---|---|---|---|
| 886519 | 8/1953 | Fed. Rep. of Germany | 135/24 |
| 1106934 | 5/1961 | Fed. Rep. of Germany | 135/24 |
| 556343 | 27/1957 | Italy | 135/38 |
| 324574 | 1/1930 | United Kingdom | 135/38 |
| 2240038 | 7/1991 | United Kingdom | 135/24 |

*Primary Examiner*—David A. Scherbel
*Assistant Examiner*—Lan Mai

[57] ABSTRACT

A fully automatic collapsible umbrella comprises a hollow shank including an upper, a middle and a lower tubes, telescopic to each other, an expansion spring disposed between the upper and lower tubes, and an umbrella closing spring disposed between the upper and middle tubes, as well as an upper, a middle and a lower rings; a grip mounted outside of the lower tube at lower portion, having an actuator for carrying out the umbrella opening and closing operation; a pawl provided at the upper portion of the upper tube; an inner tube provided with a positioner; twin wires movably connected to each other by a connector, in which the upper wire is provided at upper end with a slidable block for controlling the pawl and the lower wire is operated at lower end by the actuator; and an umbrella opening spring disposed between the middle and lower rings. Further, a safety member is provided for prevent the umbrella from opening by accident.

7 Claims, 5 Drawing Sheets

FULLY AUTOMATIC COLLAPSIBLE UMBRELLA

FIELD OF THE INVENTION

This invention relates to an automatic umbrella, more particularly to a collapsible umbrella which can be both opened and closed automatically.

Conventionally, so called automatic umbrella in general can be only opened rather than closed automatically. This assignee disclosed in his U.S. Pat. Nos. 4,534,374, 4,548,222 and 4,823,821, a series of automatic umbrella which can be both opened and closed automatically, but due to the design of the construction and the arrangements of various compression springs, an operating force required to open the umbrella is so big that any user is unable to operate it with a single hand, hence its manufacture and sale have long been hesitated so far.

The same assignee further filed a U.S. patent application on Jul. 31, 1991, under application Ser. No. 07/738,666, now U.S. Pat. No. 5,088,512 entitled "Lightly Operable Fully Automatic Umbrella", which can be lightly operated with single hand, but not suitable to collapsible umbrella.

SUMMARY OF THE INVENTION

It is, therefore, an object of the present invention to provide a fully automatic collapsible umbrella which can be opened and closed lightly with a single hand by means of a single push button type actuator.

This object is accomplished by a fully automatic collapsible umbrella according to the present invention, which comprises a hollow shank including an upper polygonal tube, a middle circular tube and a lower circular tube, telescopic to each other, an expansion spring disposed between said upper and lower tubes, and an umbrella closing spring disposed between said upper and middle tubes, as well as an upper, a middle and a lower rings; a grip mounted outside of said lower tube at lower portion, having an actuator for carrying out the umbrella opening and closing operation, said actuator includes a retention member for controlling said expansion spring at a compressed, energy accumulated state; a pawl provided at the upper portion of said upper tube for controlling said umbrella closing spring at a compressed, energy accumulated state; an inner tube provided with a positioner to secure said lower tube and a polygonal fitting member fitted into said upper tube for preventing said shank from vibration; twin wires movably connected to each other by means of a connector, in which the upper wire is provided at upper end with a slidable block for controlling the action of said pawl and the lower wire is operated at lower end by said actuator to carry out the umbrella closing operation; an umbrella opening spring disposed between said middle and lower rings; and a ribs structure.

Another object of the present invention is to provide aforementioned collapsible umbrella with a safety member outside of said upper tube at upper end below said upper ring to retain the ribs structure for preventing the umbrella at closed state from opening by accident.

BRIEF DESCRIPTION OF THE DRAWINGS

The foregoing and other objects, features and advantages of the invention will be apparent from the following particular description of preferred embodiments of the invention as illustrated in the accompanying drawings, in which.

DETAILED DESCRIPTION OF PREFERRED EMBODIMENTS

Figure 1:
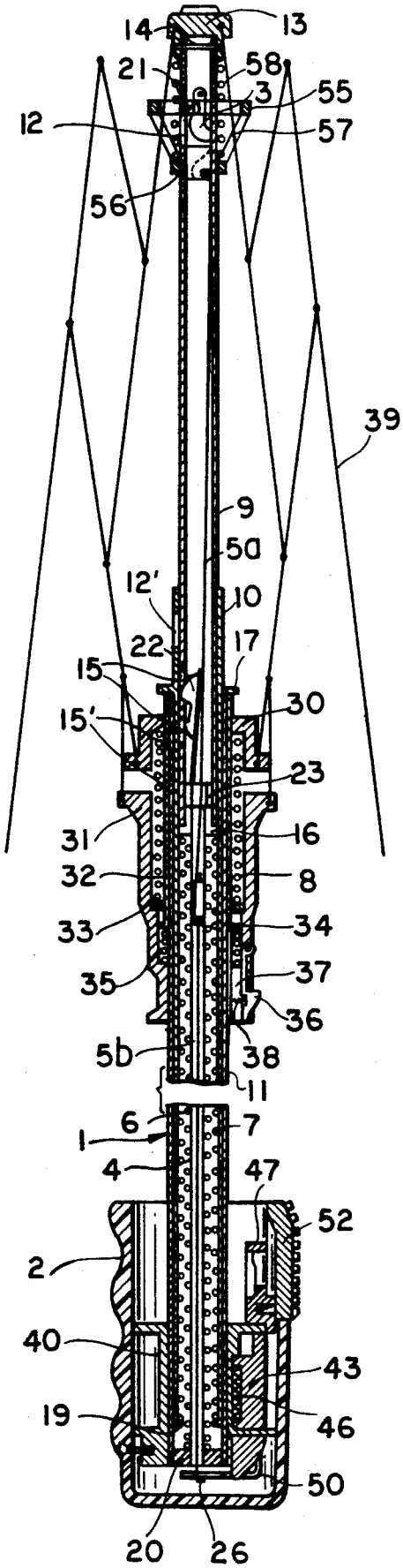
FIG. 1 is an elevational cross section view of the automatic collapsible umbrella according to present invention.
Figure 2:
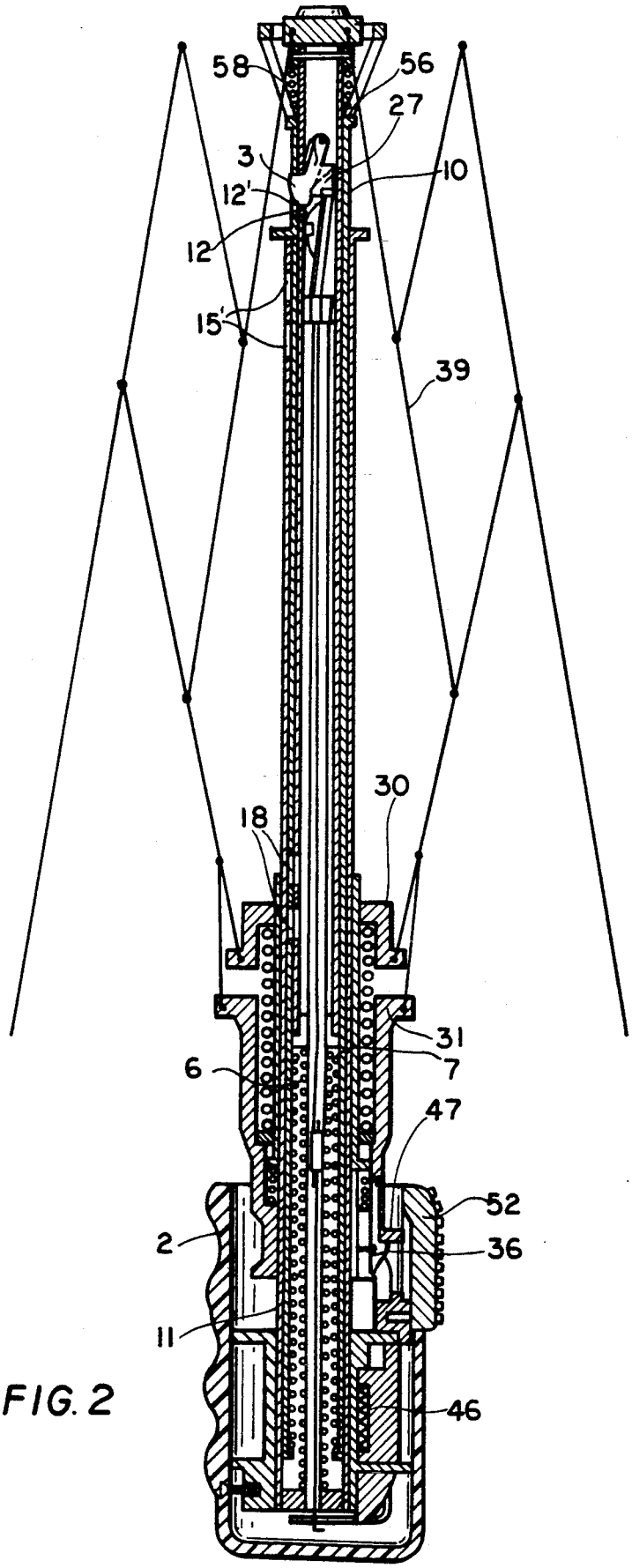
FIG. 2 is a cross section view illustrating the automatic umbrella in the shortening state for storage or the preparative stage before opening.
Figure 3:
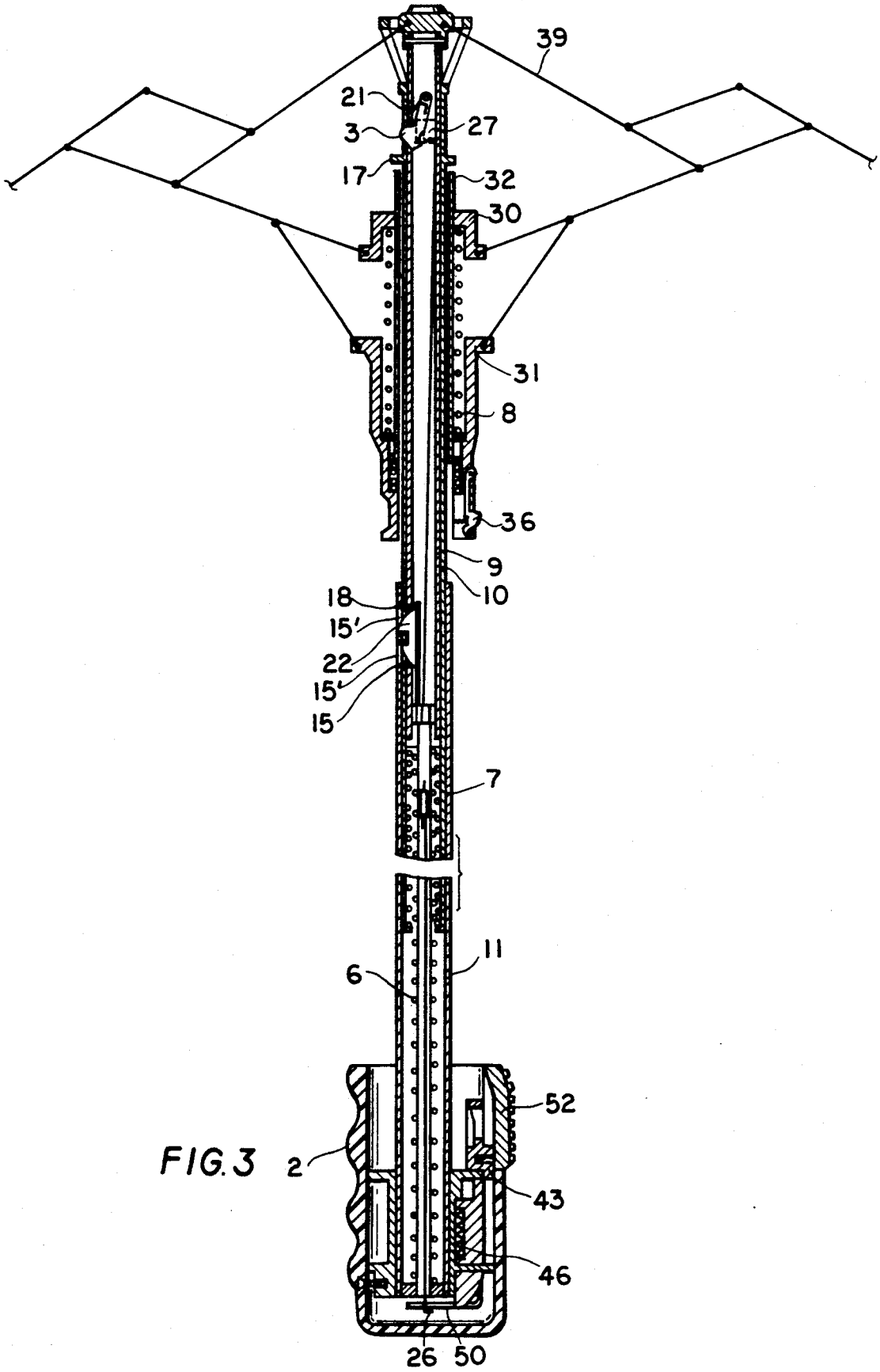
FIG. 3 is a cross section view illustrating the umbrella in the opening state.

Now, reference is made to FIG. 1, in which the fully automatic collapsible umbrella according to the present invention comprises mainly a shank 1, a grip 2, a pawl 3, an inner tube 4, twin wires 5*a* and 5*b*, an expansion spring 6, an umbrella closing spring 7 and an umbrella opening spring 8. The shank 1 includes an upper tube 9, a middle tube 10 and a lower tube 11. The upper tube 9 is preferably in polygonal, for example, hexagonal cross section while the middle and the lower tubes 10 and 11, respectively, are circular. The upper tube 9 is provided at upper portion with an opening 12 and engaged at top end with an upper ring 13 by means of, for example, a pin 14. The upper tube 9 is formed at lower portion with a double positioning hole 15 and engaged at bottom end with a plug 16. The middle tube 10 positioned around and telescopic in relation to said upper tube 9 is provided at upper end with a peripheral flange 17, at middle portion with a double positioning hole 18 (as shown in FIGS. 2 and 3) in the proximity of top end with an opening 12' and at bottom end with an inner lip 19. The compressible umbrella closing spring 7 is received with the space between said inner lip 19 and said plug 16 of said upper tube 9. The lower tube 11 positioned around and telescopic in relation to said middle tube 10 is engaged at bottom end with a plug 20. The compressible expansion spring 6 is received within the space between said plug 20 and the plug 16 of said upper tube 9. The lower tube 11 is formed at upper end with a double positioning hole 15'. The pawl 3 is disposed on said upper tube 9 at upper end and normally biased into said upper tube 9 by means of a spring clip 21.

Figure 5:
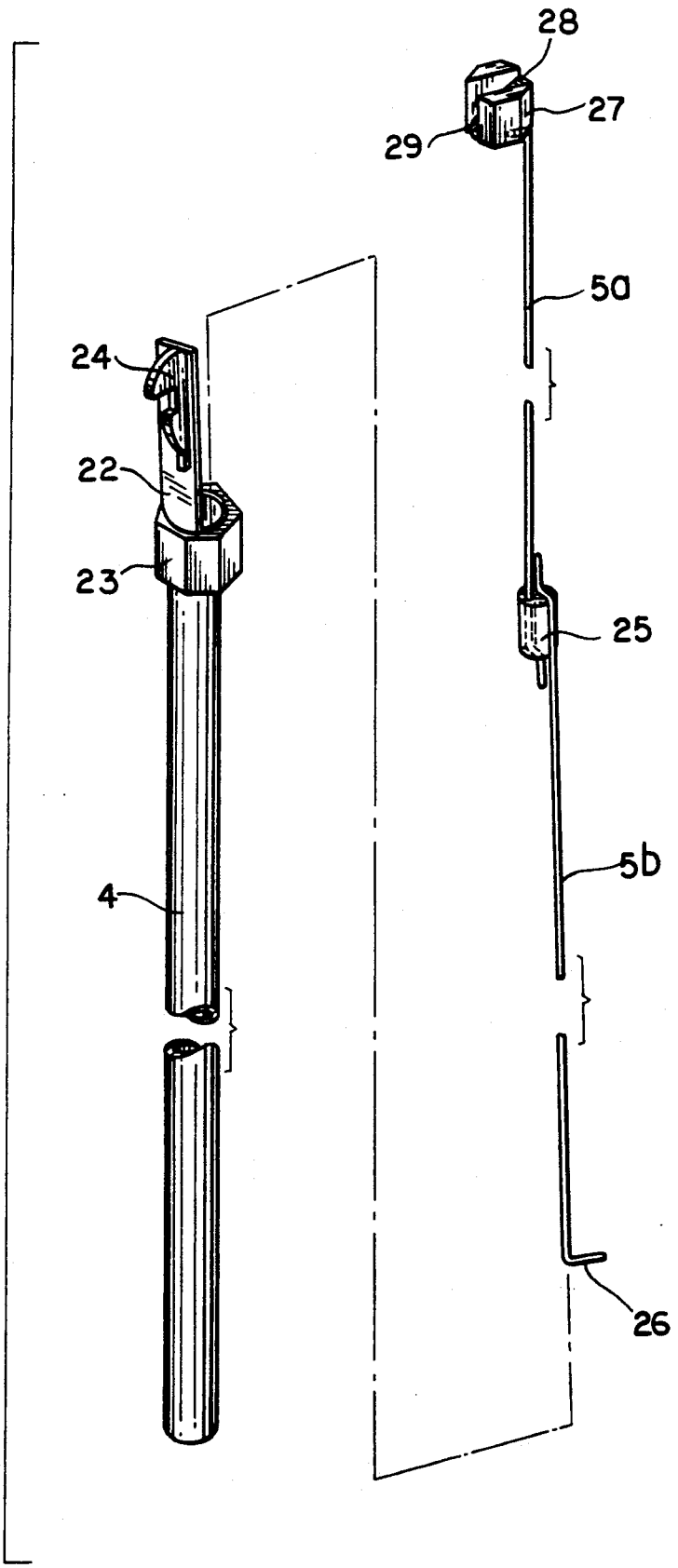
FIG. 5 is a perspective view of the inner tube and twin wires along with the relevant members.

The inner tube 4 is at bottom end securely engaged into said plug 20 and at top end provided with a positioner 22 and a fitting member 23. The positioner 22 is composed of a double hook portion 24 formed on a spring leaf. The fitting member 23 has a polygonal, for example, hexagonal cross section corresponding to said upper tube 9 (as best shown in FIG. 5), to be fitted therein for preventing the positioner 22 from vibration. The twin wires are received within and emerged out of the inner tube 4. The wires comprise, an upper wire 5*a* and a lower wire 5*b* which are movably connected to each other by a connected 25. The connector 25 may be disposed within said inner tube 4 and formed with two substantially diagonal grooves for receiving said wires 5*a* and 5*b*, respectively. The upper wire 5*a* at lower end and the lower wire 5*b* at upper end are deflected, respectively, to an extent that to be restrained by said connector 25. The lower wire 5*b* at bottom end is also bent at almost 90 degrees to form an end hook 26. The upper wire 5*a* is at top end engaged into a slidable block 27 which also has a polygonal, for example, hexagonal cross section in periphery to cooperate with the configuration of said upper tube 9 for preventing from any vibration. The slidable block 27 has a central recessed slop 28 with a rounded bottom end 29. A middle ring 30 and a lower ring 31 are provided outside of the sleeve 32 which is slidable in relation to the shank 1. The compressible umbrella opening spring 8 is received within a space between said middle and lower rings 30 and 31, respectively, and outside of said sleeve 32. Said spring 8 is at lower end terminated at a collar 33. Beneath a flange 34 at bottom of said sleeve 32 is provided with a buffer spring 35. At lower end of said lower ring 31 is provided with a locking member 36 and corresponding recess 37. The locking member 36 is normally biased outwards with a spring 38.

The canopy ribs structure 39 is similar to conventional one and pivotably connected to said upper, middle and lower rings 13, 30 and 31, respectively.

Figure 4:
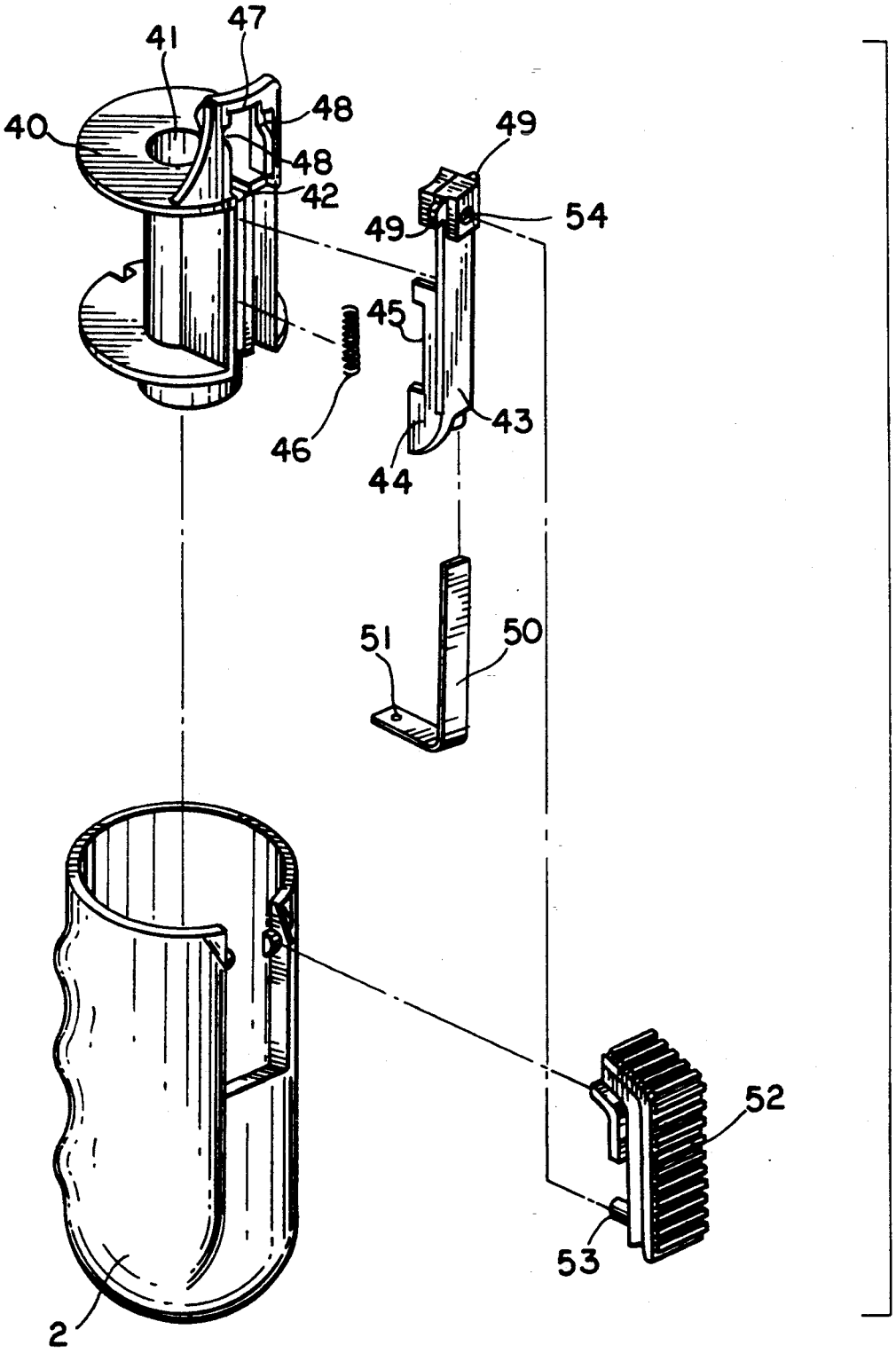
FIG. 4 is an exploded perspective view of the grip and the push button type actuator thereof.

Additionally referred to FIG. 4, the grip 2 receives an actuator comprising a seat 40 including a central opening 41 for the lower tube 11 inserted therein and a channel 42 to receive the land 44 of an actuating member 43. Said land 44 has a notch 45 to receive a return spring 46. Over said seat 40 is projected with a retention member 47 in beam type which has a recess 48 at opposite lateral sides. The actuating member 43 at upper end has a corresponding wing type protrusion 49 which is normally not in alignment with said recess 48. Below the actuating member 43 is provided with an angle plate 50 having an aperture 51 for the end hook 26 of the lower wire 5*b* passing therethrough. Outside of the actuating member 43 on the grip 2 is provided with a push button 52 which has a pin 53 in engagement with an insertion hole 54 on said actuating member 43.

The umbrella according to the present invention further comprises a safety member provided at upper end of said upper tube 9 below the upper ring 13. The safety member includes an upper loop 55, a lower loop 56 slidable outside of the upper tube 9 and a plurality of tie rods 57 interconnecting said loops 55 and 56. When the umbrella is in closing state, the safety member is biased downwards by means of an actuating spring 58 to restain the ribs structure 39 so as to prevent it from opening by accident.

With the construction mentioned above, the present fully automatic collapsible umbrella in closing state is substantially illustrated in FIG. 1. In preparing to open the umbrella the user at first holds the grip 2 to put the upper ring 13 at the utmost top end of the umbrella against the ground or a wall surface or his another hand, then applies a slight force to cause the middle and lower tube 10 and 11, respectively, displaced with respect to the upper tube 9. During this process the umbrella closing spring 7 and the expansion spring 6 are compressed to become a preparative state, as shown in FIG. 2. In this state, the locking member 36 at the lower ring 31 is retained by the retention member 47 on the seat 40 inside of the grip 2 to lock the lower tube 11 in fixed position, namely, maintaining the expansion spring 6 in a compressed state. In the meantime the middle tube 10 is displaced upwards to move up the safety member by abutting against the lower loop 56 in counteract to the spring 58 and thus the ribs struction is released from the restrained state. The slidable block 27 on the top end of the upper wire 5*a* is also pushed upwards by the positioner 22 in such that the recessed slope 28 receives the pawl 3 and push it outwards to lock the opening 12' in alignment with the opening 12, securing the middle tube 10 in a fixed state, namely, maintaining the umbrella closing spring 7 in a compressed state.

In opening operation, the push button is lightly driven upwards to push the actuating member 43 (also referred to FIG. 4), then the wing type protrusion 49 is displaced to the position of the recess 48 in such that the locking member 36 can be pressed down by the actuating member 43 to release from the retention member 47. The push button 52 is returned to the normal position under the action of the return spring 46. As soon as the locking member 36 is released, as shown in FIG. 3, the lower tube 11 is moved downwards under the action of the expansion force exerted by the expansion spring 6. Since the grip 2 is hold by the hand (not shown) so that in effect the upper tube 9 and the middle tube 10 are displaced upwards in relation to the lower tube 11. Meanwhile, in the process of upward movement of the middle and lower rings 30 and 31, respectively, the umbrella opening spring 8 is expanded and thus the ribs structure 39 is pivotably opened. By the way, the double hook portion 24 of the positioner 22 is locked into the aligned double positioning holes 15, 18 and 15' to secure the lower tube 11 and to prevent it from vibration.

When the opened umbrella is going to be closed the push button 52 is driven downwards the end hook 26 of the lower wire 5*b* is pulled down by the angle plate 50 below the actuating member 43, then the push button 52 is returned to the normal position by means of the return spring 46. The slidable block 27 is pulled away from the pawl 3 by means of the upper wire 5*a*, then the pawl 3 is biased inwards by the spring clip 21. In the meantime, the middle tube 10 displaced downwards with respect to the upper tube 9 under the action of the expansion force exerted by the umbrella closing spring 7, and pushes the positioner 22 inwards, simultaneously, moves the sleeve 32 as well as the middle and lower rings 30 and 31, respectively, downwards by means of the peripheral flange 17 and compresses the umbrella opening spring 8 accordingly. In turn, the ribs structure 39 is collapsibly closed. The lower loop 56 of the safety member is pushed downwards by the spring 58 and retained around the ribs structure 39 in a state as shown in FIG. 1.

As mentioned above, the arrangement and construction of the fully automatic collapsible umbrella according to the present invention are lightly operable. Moreover, the corresponding springs 7 and 8 are ready in a compressed energy accumulated state before closing or opening the umbrella, so that the operation is made fast and positive.

Although the invention has been described in detail with reference to its presently preferred embodiment, it will be understood by one skilled in the art that various medifications, changes and variations can be made without departing from the spirit and scope of the invention.

What I claim is:

1. A fully automatic collapsible umbrella comprising, in combination, a hollow shank including a polygonal upper tube having an opening at upper end and a positioning hole at lower end, a circular middle tube having an opening at upper end and a positioning hole at middle section, a circular lower tube having a positioning hole at upper end, an upper, a middle and a lower rings, an expansion spring disposed between said upper and lower tubes, and an umbrella closing spring disposed between said upper and middle tubes;

a grip mounted outside of said lower tube at lower portion, having an actuator for carrying out the umbrella opening and closing operation, said actuator including a retention member for controlling said expansion spring in a compressed state;

a pawl provided at the upper portion of said upper tube for controlling said umbrella closing spring at a compressed state;

an inner tube provided with a positioner to secure said lower tube through engagement with said positioning holes of said upper, middle and lower tubes in alignment to each other;

twin wires movably connected to each other by means of a connector, in which the upper wire provided at upper end with a slidable block for controlling the action of said pawl and the lower wire being operated at lower end by said actuator to carry out the umbrella closing operation;

an umbrella opening spring disposed between said middle and lower rings; and a ribs structure.

2. A fully automatic collapsible umbrella according to claim 1, wherein said positioner further comprises a polygonal fitting member to be fitted within said corresponding polygonal upper tube to prevent said shank from vibration.

3. A fully automatic collapsible umbrella according to claim 1, wherein said slidable block is in a form of polygonal configuration and has a central recessed slop with rounded bottom end.

4. A fully automatic collapsible umbrella according to claim 1, further comprising a sleeve interposed between said umbrella opening spring and said shank.

5. A fully automatic collapsible umbrella according to claim 1, wherein said positioner includes a double hook portion formed on a spring leaf, while said positioning holes of said upper middle and lower tube are each double holes.

6. A fully automatic collapsible umbrella according to claim 1, wherein said actuator comprises a seat including a central opening for said lower tube inserted therein, a channel and a retention member having a recess at opposite lateral sides; an actuating member having a land received into said channel, said land is formed with a notch to receive a return spring, said actuating member further has at upper end a wing type protrusion and at lower end an angle plate in engagement with said lower end of said lower wire; and a push button engaged with said actuating member for push upwards or downwards to carry out the umbrella opening or closing operation.

7. A fully automatic collapsible umbrella according to claim 1, further comprising a safety member provided at upper end of said upper tube below said upper ring, normally biased downwards to restrain said ribs structure to prevent it from opening by accident and to be released by upward displacement under the action of said middle tube.

* * * * *